US005871265A

United States Patent [19]

Stewart et al.

[11] Patent Number: 5,871,265

[45] Date of Patent: Feb. 16, 1999

[54] TWO-WAY SLIDE

[75] Inventors: Kris M. Stewart, Santa Ana; Charles A. Milligan, Seal Beach, both of Calif.

[73] Assignee: Accuride International Inc., Santa Fe Springs, Calif.

[21] Appl. No.: 728,138

[22] Filed: Oct. 9, 1996

[51] Int. Cl.[6] ..... A47B 88/00

[52] U.S. Cl. ..... 312/334.8; 312/333; 384/21

[58] Field of Search ..... 312/330.1, 334.1, 312/334.7, 334.8, 334.11, 334.17, 334.22, 334.44, 334.46, 334.47, 333, 334.27, 334.32, 334.33, 334.38; 384/18, 19, 20, 21, 22

[56] References Cited

U.S. PATENT DOCUMENTS

| | | | |
|---|---|---|---|
| 3,033,638 | 5/1962 | Tomlinson | 312/334.8 |
| 4,200,342 | 4/1980 | Fall | 384/20 X |
| 4,998,828 | 3/1991 | Hobbs | 384/21 X |
| 5,033,805 | 7/1991 | Hobbs | 312/334.11 |
| 5,417,490 | 5/1995 | Hobbs et al. | 312/334.32 X |
| 5,466,060 | 11/1995 | Hoffman | 312/334.8 |
| 5,484,209 | 1/1996 | Weng | 384/18 |
| 5,551,775 | 9/1996 | Parvin | 312/334.11 |
| 5,577,821 | 11/1996 | Chu | 312/334.7 X |

FOREIGN PATENT DOCUMENTS 3930713 3/1991 Germany .

*Primary Examiner*—Peter M. Cuomo
*Assistant Examiner*—James O. Hansen
*Attorney, Agent, or Firm*—Christie, Parker & Hale, LLP

[57] ABSTRACT

A sequencing latch that prevents an intermediate slide member of a drawer slide assembly from protruding from a two-way cabinet or rack. A latching arm mounted to the intermediate slide member responds to forces exerted by cams attached to the inner slide member by moving in conjunction with the inner slide member until the latching arm is able to pivot through an aperture in the intermediate slide member and be engaged by a receptacle of the outer slide member. The use of dual cams and receptacle allows for bi-directional travel limitation of the intermediate slide member.

12 Claims, 11 Drawing Sheets

125
151
127
123
153
121
107

TWO-WAY SLIDE

FIELD OF THE INVENTION

The present invention relates to sequencing latches for ball bearing slides. The invention specifically relates to a sequencing latch for a two-way slide capable of preventing a slide member connected to other slide members from protruding from the other slide members, as well as sequencing the motion of the slide members in two directions.

BACKGROUND OF THE INVENTION

Telescopic slides for file drawers and the like are often desirable for use in cabinets and other rack mounted applications. Such slides permit easy access to the interior of the drawer. The slides maintain the drawer in a horizontal position regardless of how far the drawer is withdrawn from the cabinet. A typical telescopic drawer slide has two or three slide members, often slidably secured to each other by sets of ball bearings riding in raceways formed on the slide members.

Three element telescopic slides normally include an outer slide member, an intermediate slide member, and an inner slide member. The outer slide member is connected to the cabinet or enclosure. The slide member affixed to the drawer is the inner slide member. The intermediate slide member is slidably connected to both the outer and inner slide members. In such a configuration, when the drawer is in a fully-open position the slide members will be positioned such that the intermediate slide member is extended relative to the outer slide member and the inner slide member is extended relative to the intermediate slide member.

In certain applications, it is desirable for a drawer to be able to be opened from both the front and the rear of a cabinet or rack. Such a drawer may be called a two-way drawer, the two-way drawer allowing access to the contents of the drawer from the front and rear end of the cabinet. The slide for such a drawer may be called a two-way slide. It is desirable in a two-way drawer to avoid having the intermediate slide member, which is connected neither to the drawer nor to the cabinet, from protruding from either end of the cabinet when the drawer is in a closed position. If the intermediate member does protrude from the cabinet and the drawer is in a closed position, users of the cabinet, or other people, may injure themselves by bumping against the protruding intermediate slide member. Equipment may also be damaged by bumping against a protruding intermediate slide member. The intermediate slide member may also be damaged in such a situation.

Furthermore, a typical drawer is supported by two slide assemblies, one at each side. It is desirable that the slide members of both slide assemblies extend in the same order. This is so because for a given total extension of the slide assembly the vertical deflection under a given load may be dependent on the specific relative extensions of the inner and intermediate slide members. If the two slide assemblies have not extended in the same order the drawer will have a tendency to tilt toward the weaker side.

A two-way slide assembly is disclosed in German Pat. DE 3930713 A1. An embodiment of such a two-way slide assembly is shown in FIGS. 1–4. This two-way slide has an inner slide member 11, an outer slide member 13 of substantially the same dimensions as the inner slide member 11, and an intermediate slide member 15 that fits within and between the inner slide member 11 and the outer slide member 13. All of the slide members 11, 13, and 15 are of substantially the same length. This two-way slide prevents the protrusion of the intermediate slide member 15 in the closed or retracted position through the use of end stops 17, 19, mounted on arms 21 near each end of the intermediate slide member 15.

The end stops 17, 19 are small wheels which run along raceways 23 and 25 of the inner slide member 11 and the outer slide member 13. The distance between the end stops 17, 19 mounted on the arm 21 is greater than the distance between raceways 23 and 25. At each end of the intermediate slide member one end stop 17 runs in a raceway 23 of the inner slide member 11 and the other end stop 19 runs in a raceway 25 of the outer slide member 13. Referring now to FIG. 4, the intermediate slide member 15 is prevented from traveling in one direction with respect to the inner slide member 11 due to the end stop 19 contacting the inner slide member 11.

When the slide is in the fully closed position, however, the end stops 17, 19 protrude from the ends of the slide. Additionally, the inner slide member 11, and outer slide member 13 are the same dimensions, thus preventing true telescopic action.

Mounting two slide members, namely the inner slide member 11 and the outer slide member 13, of substantially the same dimensions, with the intermediate slide member 15 mounted within them, necessarily increases the overall width of the slide assembly. The extra width is undesirable because it increases the necessary clearance between the drawer and the cabinet. Protruding end stops are also undesirable. Protruding end stops limit the possible extension of the drawer by requiring space in a closed drawer that would otherwise be available for the slide members. Protruding end stops also subjects the end stops to possible damage. Furthermore, the use of end stops does not provide for a method to sequence the extension of the slide members.

A telescopic drawer slide with a mechanical sequencing latch is shown in U.S. Pat. No. 5,551,775 by Jackie D. Parvin, the disclosure of which is incorporated by reference herein. This slide, however, does not provide for the possibility of two-way travel.

BRIEF SUMMARY OF THE INVENTION

The present invention provides a sequencing mechanism that prevents an intermediate slide member of a telescopic slide assembly from substantially protruding in a direction of travel from both an outer slide member and an inner slide member. The sequencing mechanism also prevents the intermediate slide member from traveling independent of the motion of both the inner or outer slide members. The sequencing mechanism has a latch arm mounted to the intermediate slide member such that the latch arm may pivot about an axis. The latch arm is capable of protruding through an aperture of the intermediate slide member and being received or engaged by an aperture of the outer slide member. The latch arm is caused to pivot or be biased by a cam on the inner slide member that contacts the upper surface of the latching device. The upper surface of the latch arm is contoured in such a way that if the latch arm is pivoted in one direction into engagement with the outer slide member the cam is positionable between the latch arm and the inner slide member. However, if the latch arm is not pivoted in the one direction into engagement with the outer slide member, that cam presses against the latch arm causing the intermediate slide member to move in the direction of travel.

The use of an additional opposing cam on the inner slide member along with an appropriately contoured upper surface of the latch arm allows travel of the intermediate slide member with respect to the inner slide member when the latch arm is pivoted into engagement with the outer slide member. When the latch arm is not pivoted into engagement with the outer slide member the intermediate member is restricted by the cams to movement in conjunction with the inner slide member.

BRIEF DESCRIPTION OF THE DRAWINGS

Details of the invention are described below and will be more fully appreciated with reference to the accompanying drawings.

DETAILED DESCRIPTION

Figure 2:
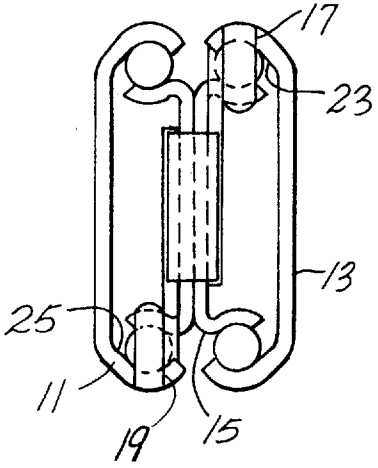
Fig. 2 PRIOR ART
FIG. 2 is an end view of the prior art two-way slide of FIG. 1.
Figure 1:
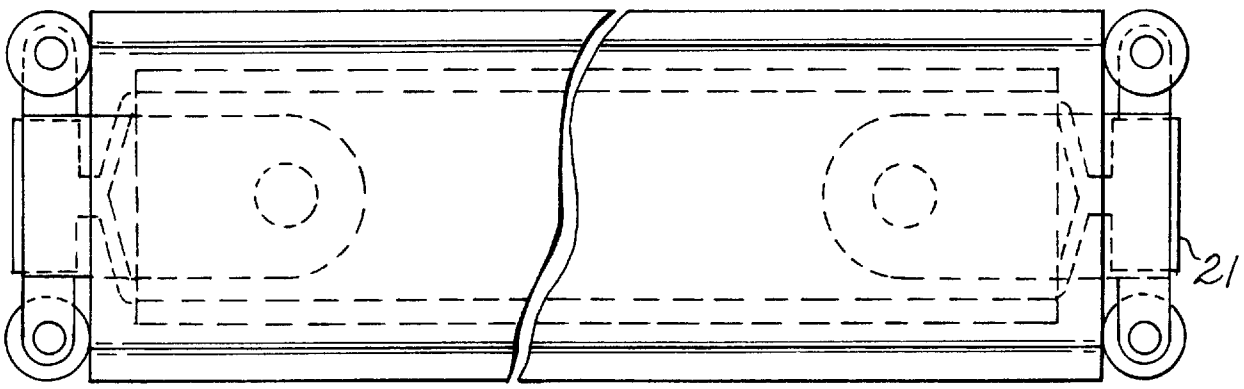
Fig. 1 PRIOR ART
FIG. 1 is a side view of a prior art two-way slide in the closed position.
Figure 3:
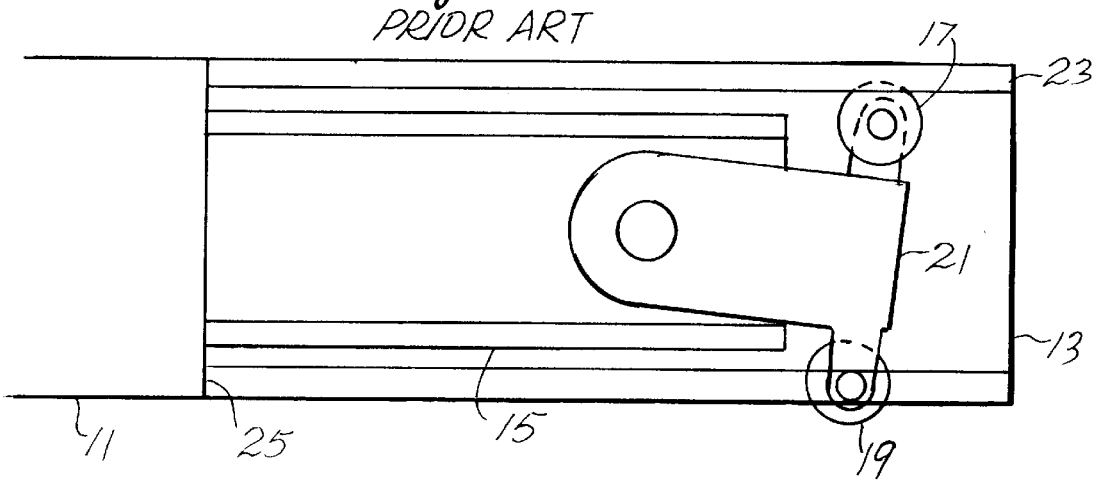
Fig. 3 PRIOR ART
FIG. 3 is a side view of the prior art two-way slide of FIG. 1 in a partially extended position.
Figure 4:
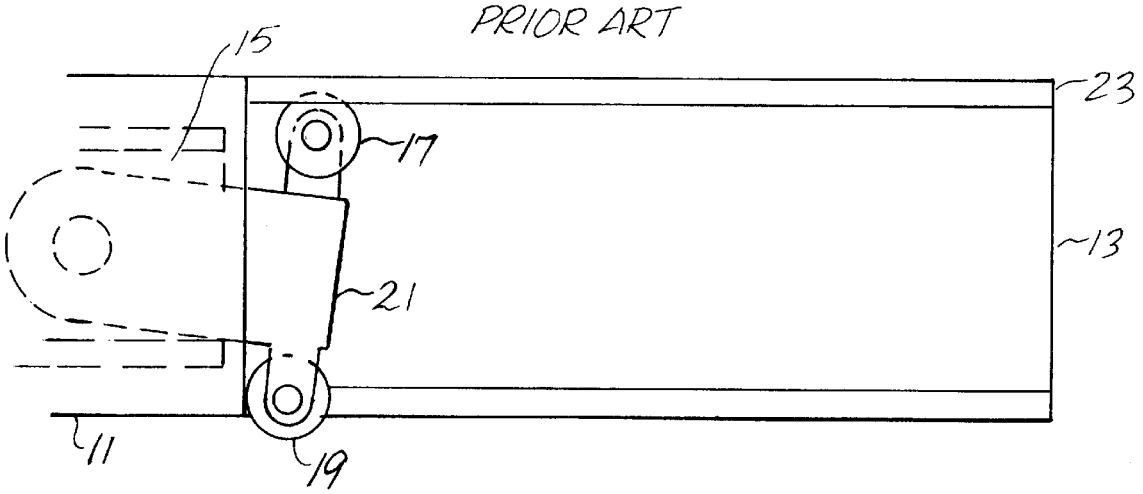
Fig. 4 PRIOR ART
FIG. 4 is a side view of the prior art two-way slide of FIG. 1 in the fully extended position.
Figure 5:
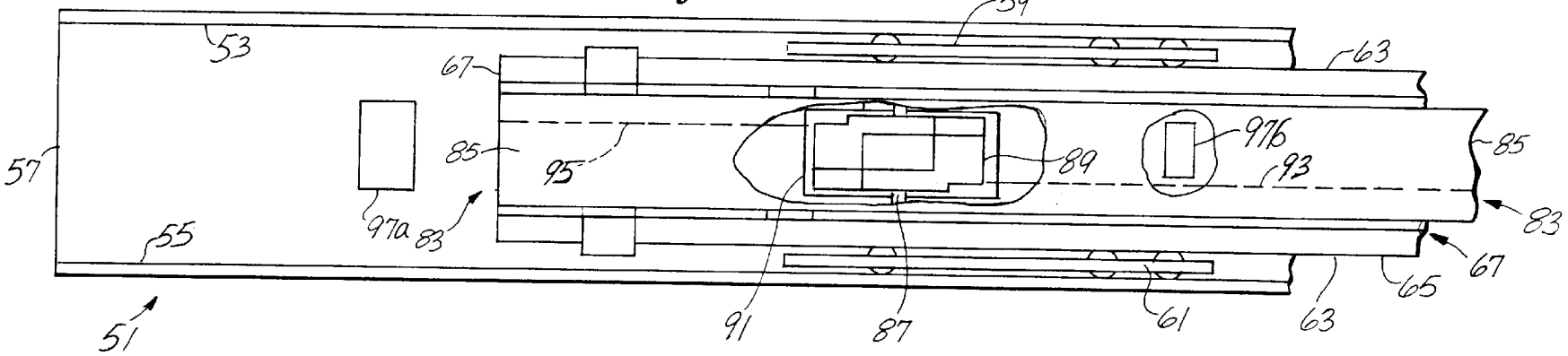
FIG. 5 is an in-board side view of an embodiment of the slide of the present invention in the partially extended position.
Figure 6:
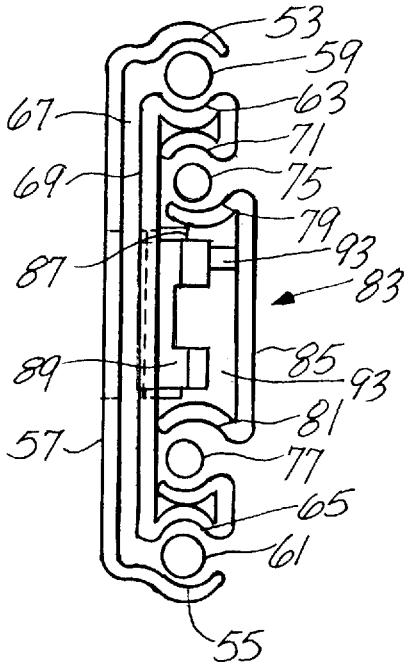
FIG. 6 is an end view of the slide of FIG. 5 in the closed position.

The present invention is shown in FIGS. 5–13. Referring to FIG. 5 an outer slide member 51, is of a generally C-shaped cross-section (FIG. 6). The outer slide member 51 is referred to by a number of terms, such as a base slide member or as a stationary slide member. As viewed in FIG. 5, the outer slide member 51 has a pair of ball bearing raceways, an upper raceway 53 facing down and a lower raceway 55 facing up. These raceways can be said to be a pair of raceways facing vertically inward. The vertical direction being used only for reference, the slide may be placed in any number of orientations. The upper and lower raceways 53, 55 are formed in the top and bottom portions of the outer slide member 51, and are supported by a substantially flat vertical web 57 forming the outward side of the slide member 51 which is secured to the cabinet. The web need not be substantially flat, a number of structures may be used to connect the raceways.

A first plurality of upper and lower bearings 59, 61 are located in and engage the upper and lower raceways 53, 55 respectively of the outer slide member 51.. These upper and lower bearings 59, 61 similarly engage a first upper raceway 63 and a first lower raceway 65 of an intermediate slide member 67, which is also referred to as a first telescoping slide member. Connecting the outer slide member 51 to the intermediate slide member 67 by means of the upper and lower ball bearings 59, 61 causes the slide members 51, 67 to be slidably connected. Mechanisms for slidably connecting drawer slides are well known in the art, and many variations of the above described mechanism will be apparent to those skilled in the art.

Referring now to FIG. 6 the upper and lower vertically outward facing raceways 63, 65 of the intermediate slide member 67 are also supported by a substantially flat vertical web 69. Connected also to the web 69 are a second upper raceway and a second lower raceway 71, 73 facing vertically inward which are located vertically interiorly of the vertically outward facing raceways of the intermediate slide member 67.

A plurality of upper and lower bearings 75, 77 are located in and engage the vertically inward facing raceways of the intermediate slide member 67. These bearings contact upper and lower vertically outward facing raceways 79, 81 of an inner slide member 83. The upper and lower raceways 79, 81 of the inner slide member 83 are supported by a substantially flat vertical web 85 forming the inward or interior side of the slide assembly.

Referring again to FIG. 5, a pin 87 is mounted to the inward side of the intermediate slide member 67. The pin 87 passes through a latch arm 89 such that the latch arm 89 pivots or rotates about the axis of the pin 87. Numerous mounting mechanisms may be employed to attach the latch arm 89 to the intermediate member 67 in such a way that the latch arm 89 is able to pivot. Furthermore, although the pin is shown mounted transverse to the direction of travel of the slide, it may be mounted in any direction given an appropriately shaped latch arm 89, the shape and function of which will later be discussed. The latch arm 89 is mounted over an aperture 91 in the intermediate slide member 67 such that portions of the latch arm 89 protrude through the intermediate slide member 67 when the latch arm 89 is pivoted. Although a single aperture 91 in the intermediate slide member 67 is shown, and the aperture 91 is larger than the latch arm 89, any number of apertures may be employed so long as a portion of the latch arm 89 is capable of protruding through the intermediate slide member 67.

Attached to the outward side of the web 85 of the inner slide member 83 facing the intermediate slide member 67 are a pair of cams 93, 95. The cams 93, 95 are positioned such that they contact the latch arm 89 by the travel of the inner slide member 83. The cams 93, 95 are plastic strips extending from the side of the inner slide member 83 toward the intermediate slide member 67, and are placed non-collinearly. The cams 93, 95 can also be other materials such as aluminum. The cams also may be formed in a number of different ways, including by creating a ridge or series of ridges along the inner slide member 83 through embossing or other techniques.

The web 57 of the outer slide member 51 has apertures 97*a*, 97*b* of a size such that a portion of the latch arm 89 may extend into, or be received by, the apertures 97. Because the purpose of the apertures 97 is to receive the latch arm 89, other structures may also be employed. For example, a receptacle to engage the latch arm 89 may instead be placed on the outward side of the outer slide member 51.

When a portion of the latch arm 89 extends into one of the apertures 97, the latch arm 89 and the intermediate slide member 67 will be essentially locked together with the outer slide member 51, except to the extent the portion of the latch arm 89 protruding into that aperture 97 of the outer slide member 51 is exceeded in size by that aperture 97. Additionally, the latch arm 89 and/or the apertures 97 can be shaped such that when a portion of the latch arm 89 extends into one of the apertures 97, the engagement of the latch arm 89 by that aperture 97 restricts the movement of the intermediate slide member 67 in one direction only.

Figure 7:
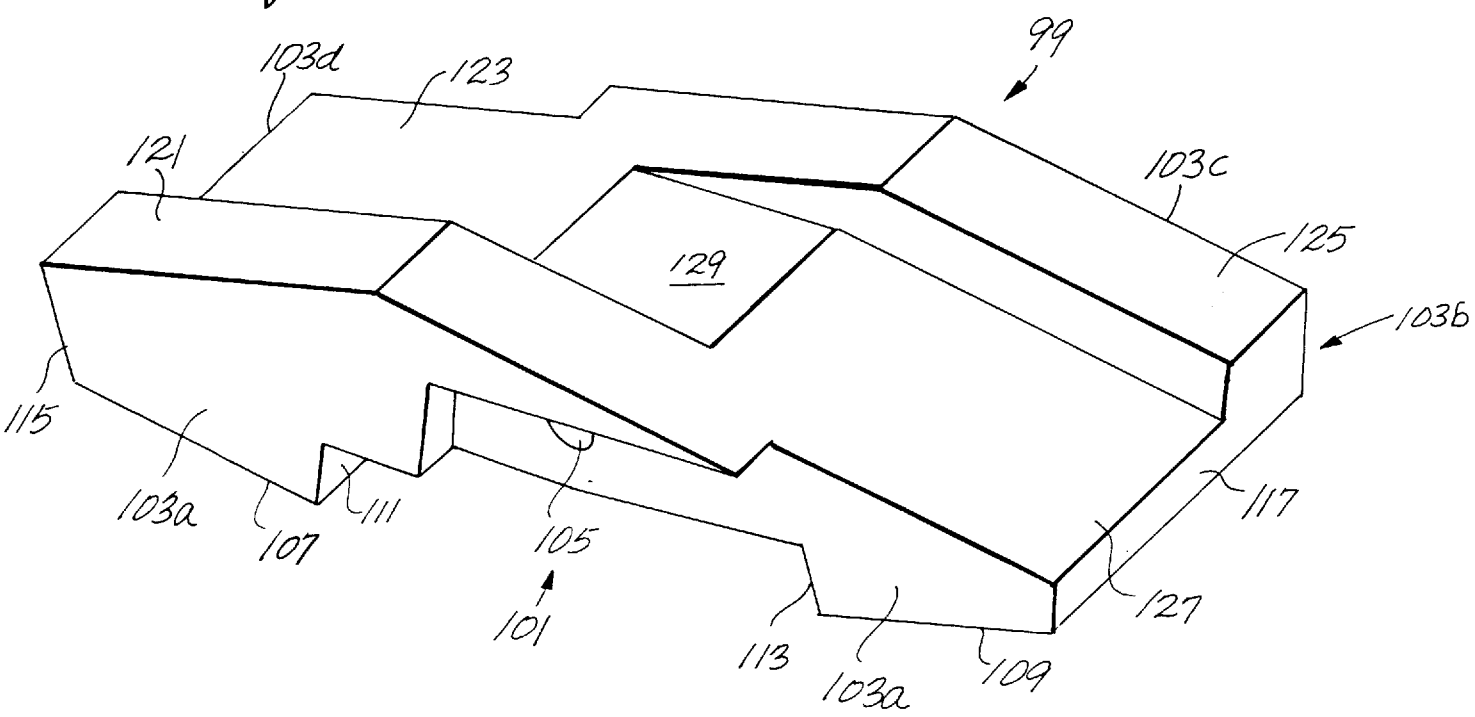
FIG. 7 is a perspective view of an embodiment of the latch arm of the present invention.

An embodiment of the latch arm 89 is shown in FIG. 7. The latch arm 89 has an upper surface 99 and a lower surface 101, connected by side surfaces 103–*d*. A passage 105 extends from one side surface 103*a* passing through the latch arm to the opposing side surface 103*c*. The pin 87 mounted to the intermediate slide member 67 is passed through the passage 105, thereby allowing the latch arm 89 to rotate or pivot about the axis of the pin 87. The presence of the passage 105 may not be required depending upon the nature of the mounting device. For example, the latch arm 89 may be formed as a unitary body with outwardly extending pins as part of that body.

The lower surface 101 of the latch arm 89 has a pair of protrusions 107, 109 at opposite ends of the latch arm 89, shown in this embodiment of the latch arm as equidistant from the passage 105. These protrusions 107, 109 are sized with respect to the apertures 91, 97 of the intermediate slide member 67 and outer slide member 51 such that the protrusions 107, 109 may pass through the aperture 91 of the intermediate slide member 67 and into the apertures 97 of the outer slide member 51. In the embodiment shown, the pair of protrusions 107, 109 both have an inward edge 111, 113 respectively. The edges 111, 113 are capable of contacting a side of the apertures 97 of the outer slide member 51 such that the latch arm 89 is prevented from moving in a first direction of travel with respect to the outer slide member 51. Similarly, the pair of protrusions 107, 109 have an outward edge 115, 117 respectively, which are capable of contacting a side of the apertures 97 of the outer slide member 51 such that the latch arm 89, and thus the intermediate slide member 67 to which the latch arm 89 is mounted, is prevented from moving in an opposing direction of travel.

For references purposes, the upper surface 99 of the latch arm 89 is divided into five regions. When the latch arm 89 is viewed as shown in FIG. 7, the upper surface 99 has a left raised surface 121, a left depressed surface 123, a right raised surface 125, a right depressed surface 127 and a middle surface 129. In the embodiment shown in FIG. 7, the left raised surface 121 and the left depressed surface 123 are substantially parallel and the right raised surface 125 and the right depressed surface 127 are substantially parallel, and the distance between the left and right depressed surfaces 123 and 127 to the left and right raised surfaces 121 and 125, respectively, are equivalent. These are not requirements, however. The surfaces need not be parallel, nor even flat, and a variety of differing distances may be employed. The middle surface 129 is utilized as a mounting platform for various items of hardware.

Referring to FIG. 7, if the latch arm 89 is pivoted such that the left regions 121, 123 of the upper surface 99 move toward the position of the lower surface 101, i.e. moves towards the outer slide member 51, the right portion of the upper surface 99 will move towards the inner slide member 83. In this position the right raised surface 125 provides less clearance, or space, along between the inner slide member 83 and a cross-section of the latch arm 89 than is provided by the right depressed surface 127. This difference in clearance, which is approximately the distance between the raised and depressed surfaces, allows cam 93 to be positioned between the right depressed surface 127 and the inner slide member 83. The clearance between the right raised surface 125 and the inner slide member 83 will no: be sufficient to allow the cam 95 to pass, or be positioned, between a surface of a cross-section of the latch arm 89 and the inner slide member 83.

Moreover, with the latch arm 89 pivoted in this manner, the protrusion 107 from the left of the lower surface 101 extends through the intermediate slide member 67 and into aperture 97*a* of the outer slide member 51. Because the latch arm 89 is mounted to the intermediate slide member 67, and because the lower left latch protrusion 107 is bound by the confines of that aperture 97 of the outer slide member, the intermediate slide member 67 is prevented from moving.

When the inner slide member 83 is positioned such that cam 93 that is capable of contact with the left raised surface 125 no longer restricts the latch arm 89 from pivoting in a manner that causes the latch arm 89 to engage aperture 97*a* of the outer slide member 51, the latch arm 89 can be caused to pivot by the force of cam 95 contacting the left depressed surface 123 of the latch arm 89. If the intermediate slide member 67 and the outer slide member 51 are not positioned such that the protrusion 109 from the right portion of the lower surface 101 of the latch arm 89 may not pass into one of the apertures 97 of the outer slide member 51, the contact between cam 95 and the latch arm 89 will cause the intermediate slide member 67 to travel in the direction which cam 95 is traveling, i.e., the direction of travel of the inner slide member 83. Thus, with the position of the cams 93, 95 as previously discussed, the contact between the cams 93, 95 and the latch arm 89 will cause the intermediate slide member 67 to move in the same direction and at the same rate as the inner slide member 51 until the latch arm 89 is able to protrude into one of the apertures 97 of the outer slide member 51. Once the intermediate slide member 67 reaches its limit of travel in a direction the intermediate slide member 67 will be unable to further travel in that direction. Placing an aperture in the outer slide member 51 so that the latch arm 89 is able to pivot when the intermediate slide member 67 reaches its limit of travel, then once the latch arm 89 does pivot the inner slide member 83 will be able to continue to move in the direction of travel.

Figure 8:
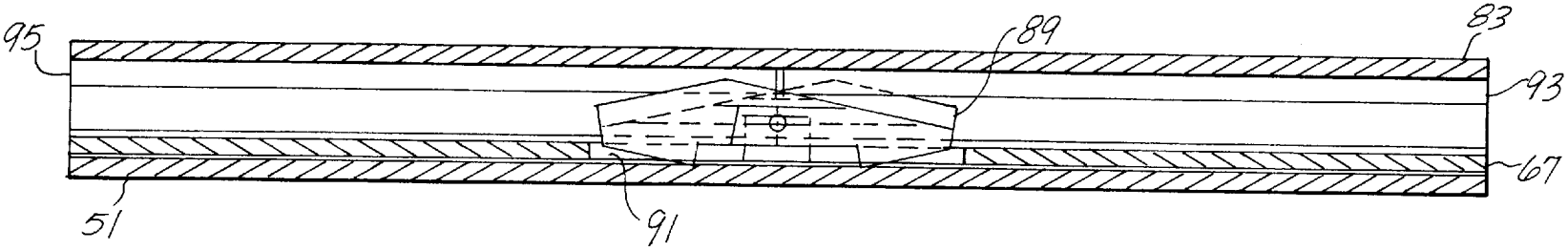
FIG. 8 is a cross-sectional side view of the slide of FIG. 5 demonstrating the slide traveling with the latch arm in the unlatched position.

The operation of the slide assembly is further illustrated in FIGS. 8–12. FIG. 8 illustrates a cutaway cross-section of the slide assembly. The outer slide member 51 and the intermediate slide member 67 are slidably connected. Thus, the intermediate slide member 67 is able to move with respect to the outer slide member 51. The latch arm 89 is pivotally mounted to the intermediate slide member 67 with a pivot axis orthogonal to the directions of travel of the slide members. The intermediate slide member 67 contains an aperture 91 through which the latch arm 89 or portions of the latch arm 89 may extend. The inner slide member 83 is slidably connected to the intermediate slide member 67. The two cams 93, 95 or strips are attached to the inner slide member 83. The cams 93, 95 are not placed in a collinear fashion, but instead placed so that they intersect surfaces of different cross-sections of the latch arm 89. As indicated in FIG. 8, the cams 93, 95 are in contact with the latch arm 89 and, since each cam prevents the latch arm 89 from moving in either direction, the latch arm 89 must move with the same movement as the inner slide member 83. Because the latch arm 89 is attached to the intermediate slide member 67, the intermediate slide member 67 is also thereby restricted in its range of travel. This limitation on the movement of the intermediate slide member 67 is not necessarily complete, however. If the cams 93 and 95 are placed such that: the latch arm 89 has a range of motion between contacting either of the two cams 93 and 95, i.e. there is a gap between the cams 93 and 95, the latch arm 89, and therefore the intermediate slide member 67, will have some movement with respect to the inner slide member 83. Such limited movement may be desirable in some applications or introduced via manufacturing errors or tolerances.

Figure 9:
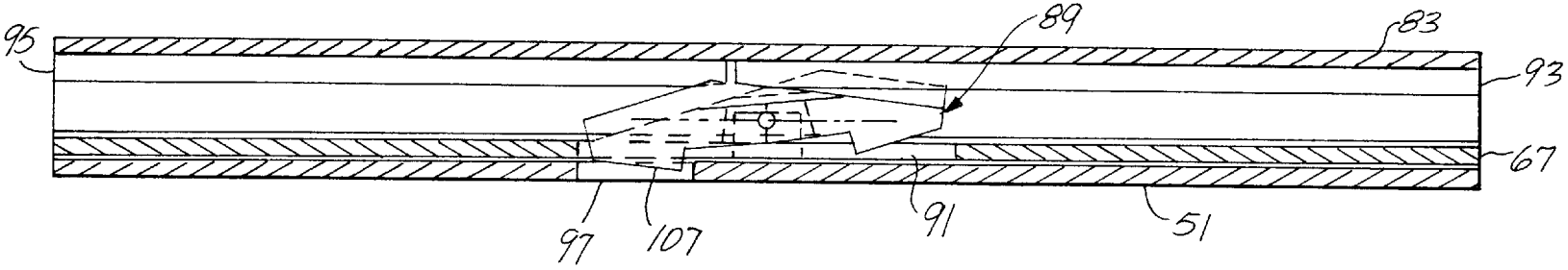
FIG. 9 is a cross-sectional side view of the slide of FIG. 5 demonstrating the slide traveling with the latch arm approaching the latched position.
Figure 10:
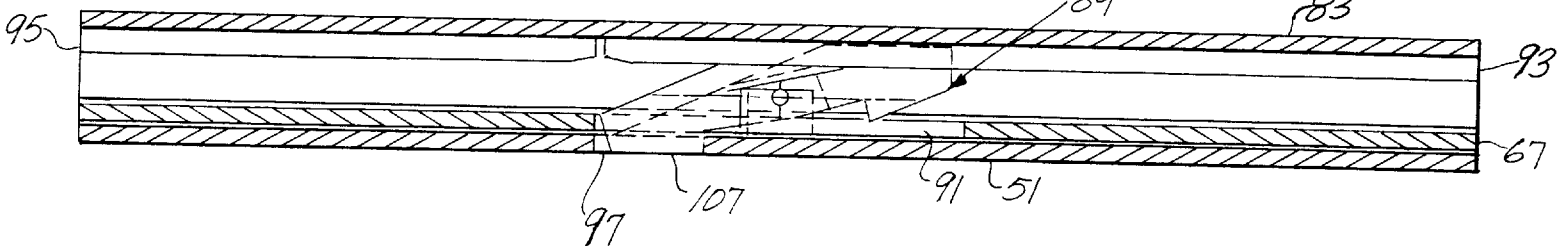
FIG. 10 is a cross-sectional side view of the slide of FIG. 5 demonstrating the slide traveling with the latch arm in the latched position.

FIG. 9 illustrates the result that occurs when the intermediate slide member 67 reaches the limit of its motion of travel in one direction. This limit can be caused by a mechanical stop or the like on the outer slide member 51. Once the intermediate slide member 67 reaches that position it cannot move farther in that direction with respect to the outer member 51. The cam 93 attached to the inner slide member 83 presses against the latch arm 89 causes the latch arm 89 pivot, forcing the lower protrusion 107 of the latch arm 89 into the aperture 97*a* in the outer slide member 51. Due to the pivot action of the latch arm 89, the surface of the latch arm 89 that cam 93 was in contact with no longer obstructs passage of cam 93, the latch arm 89 now providing sufficient clearance between the latch arm 89 and the inner slide member 83 so that the cam 93 may pass, or is positionable, between these two elements, thus allowing the inner slide member 83 to continue its direction of travel. This is illustrated in FIG. 10. FIG. 10 additionally shows that the pivoting of the latch arm 89 has caused a surface of the latch arm 89 to be placed in the pathway of the opposing cam 95 such that the surface obstructs that pathway.

By reversing the previously described motion of the inner slide member 83, cam 95 in due course comes into contact with the obstructing surface of the latch arm 89. At the same time, or shortly before, cam 93 no longer restricts the pivoting of the latch arm 89. The contact between cam 95 and the obstructing surface of the latch arm 89 causes the latch arm 89 to pivot and the lower protrusion 107 of the latch arm 89 withdraws from the aperture 97*a* of the outer slide member 51. The inner slide member 83 and intermediate slide member 67 then travel in conjunction in the manner described in FIG. 8.

Figure 11:
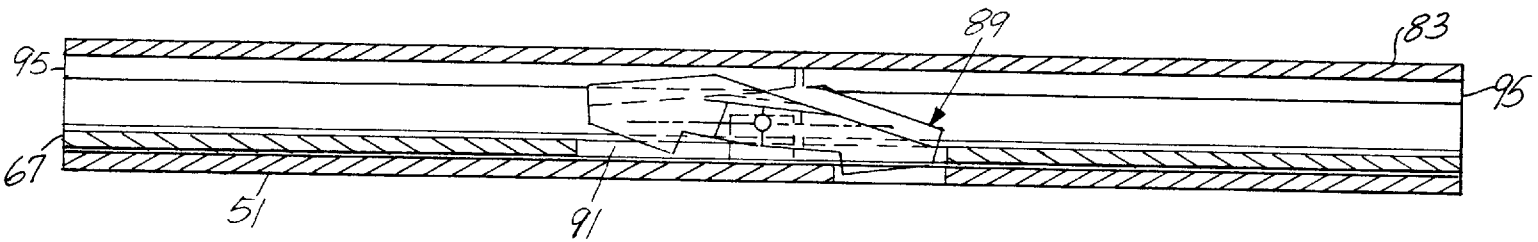
FIG. 11 is a cross-sectional side view of the slide of FIG. 5 showing the slide traveling with the latch arm approaching a second latched position.
Figure 12:
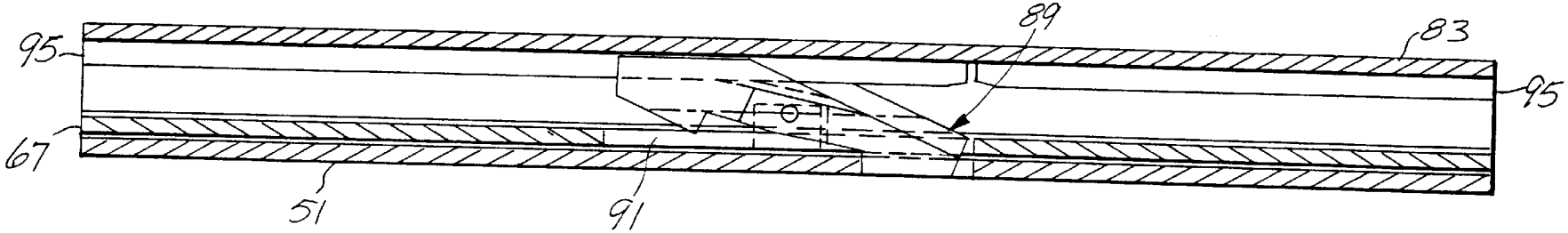
FIG. 12 is cross-sectional side view of the slide of FIG. 5 showing the slide traveling with the latch arm in a second latched position.

FIG. 11 illustrates an occurrence similar to that illustrated in FIG. 9, however at the opposite edge of the range of travel of the intermediate slide member 67. In FIG. 11 the lower protrusion 109 is being engaged by the aperture 97*b* due to the contact between cam 95 and the latch arm 89. Similarly, FIG. 12 corresponds to FIG. 10, but at the opposite end of the intermediate slide member's range of travel.

Figure 13:
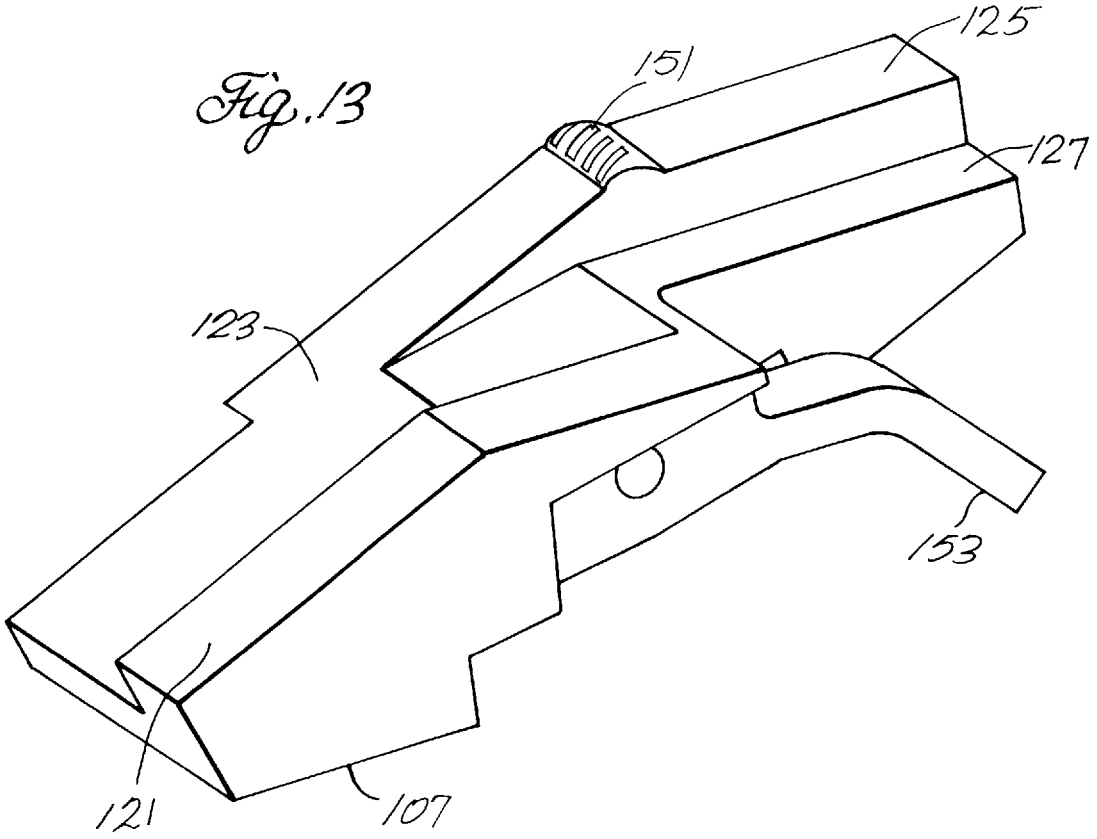
FIG. 13 shows an alternate embodiment of the latch arm of the present invention.

FIG. 13 illustrates another embodiment of the latch arm. The latch arm features a first bump 151 or raised edge at the intersection of the right raised surface 125 and the left depressed surface 123. As the intermediate slide member reaches its limit of travel in a direction, continued motion of the inner slide member in that direction causes contact between cam 93 and the bump 151 to pivot the latch arm into engagement with one of the apertures 97. A torsion arm 153 extends beyond the lower surface of the latch arm. The torsion arm 153 causes the opposite lower projection 107 of the latch arm to lock into position when pivoted into the aperture 97 of the outer member. Thus, an emboss could be used as the biasing cam for pivoting the latch arm into engagement for that direction of travel, with the latch arm remaining in engagement due to the force exerted by the torsion arm 153. A number of spring devices could be used instead of the torsion arm, so long as a pivoting force is applied.

Moreover, the bump causes the latch arm to pivot to a greater extent than occurred in the previously described embodiment. Utilization of a locking toggling device as part of the engagement mechanism of the outer slide member 51 causes the latch arm to lock or snap into place, the engagement mechanism holding the latch arm 89 in position. The engagement mechanism of the outer slide member operates similar to a push button toggle latch, wherein a first depression of the push button causes the push button to lock in a recessed position, and a second depression of the push button causes the push button to unlock and return, through the use of a spring mechanism, to the non-recessed position. Because the engagement mechanism retains the latch arm 89 in the engaged position the cam 93 need not restrict the latch arm 89 from pivoting once it has caused the latch arm 89 to pivot to the engaged position, thus the cam 93 may be a simple emboss of the inner slide member 83. When the latch arm 89 is in the engaged position, the contact between the emboss and the raised bump 151 causes the engagement mechanism to release the latch arm 89.

The raised bump 151, in conjunction with the cams, also serves as a detent device. As the cam 93 rides over the raised bump 151 greater friction is produced between the cam 93 and the latching device 89 than would otherwise be the case. Thus, the raised bump 151 creates a frictional interface, which requires additional force to overcome. Gaps placed in the cams may, in conjunction with the raised bump 151, serve as detent devices.

Although this invention has been described in certain specific embodiments, many additional modifications and variations will be apparent to those skilled in the art. It is therefore to be understood that this invention may be practiced otherwise than is specifically described. For example, the slide members may be interconnected via means other than ball bearings, or the upper surface of the latch arm may be formed in a variety of shapes so long as the necessary clearance requirements are met. Indeed, it should be apparent that although the invention is described with a latch arm that pivots along an axis orthogonal to the directions of travel of the slides, with an appropriately shaped latch the latch arm may be positioned such that it pivots along an axis parallel to that of the movement of the slides. Thus, the present embodiments of this invention should be considered in all respects as illustrative and not restrictive. The scope of the invention to be indicated by the appended claims rather than the foregoing description.

What is claimed is:

1. A two-way slide assembly comprising:

an outer slide member;

an intermediate slide member slidably connected to the outer slide member, the intermediate slide member being capable of slidably extending from the outer slide member in at least one direction;

an inner slide member slidably connected to the intermediate slide member, the inner slide member being capable of slidably extending from the outer slide member in the at least one direction and an opposing direction;

a latch arm pivotally mounted to the intermediate slide member;

a latch arm receiver on the outer slide member for engaging the latch arm, the engagement of which prevents the intermediate slide member from sliding with respect to the outer slide member in at least one direction;

an aperture in the intermediate slide member of a predetermined size positioned so that a portion of the latch arm can protrude through the aperture and engage the latch arm receiver;

a cam on the inner slide member for biasing the latch arm into engagement with the latch arm receiver;

the latch arm comprising:

a body having an upper and lower surface of a predetermined contour, wherein the lower surface is capable of partially protruding through the aperture of the intermediate slide member and of being received by the latch arm receiver;

the upper surface having a contour such that the spacing from the inner slide member to the upper surface of at least one cross-section of the latch arm is a first distance if the lower surface is engaged by the latch arm receiver and is a second distance if the lower surface is not engaged by the latch arm receiver;

with only the first distance being such that the cam is positionable between the upper surface and the inner slide member; and the cam being positioned on the inner slide member to intersect the at least one cross section.

2. The two-way slide assembly of claim 1 further comprising:

an opposing cam on the inner slide member for biasing the latch arm out of engagement with the latch arm receiver;

the latch arm upper surface having a contour such that the spacing from the inner slide member to the upper surface of a second cross section of the latch arm is the second distance if the lower surface is engaged by the latch arm receiver and is the first distance if the lower surface is not engaged by the latch arm receiver;

with only the first distance being such that the opposing cam is positionable between the upper surface and the inner slide member; and the opposing cam being positioned on the inner slide member so as to intersect the second cross section.

3. A two-way slide assembly comprising:

an outer slide member;

an intermediate slide member slidably connected to the outer slide member, the intermediate slide member being capable of slidably extending from the outer slide member in at least one direction;

an inner slide member slidably connected to the intermediate slide member, the inner slide member being capable of slidably extending from the outer slide member in the at least one direction and an opposing direction;

a latch arm pivotally mounted to the intermediate slide member;

a latch arm receiver on the outer slide member for engaging the latch arm, the engagement of which prevents the intermediate slide member from sliding with respect to the outer slide member in at least one direction;

an aperture in the intermediate slide member of a predetermined size positioned so that a portion of the latch arm can protrude through the aperture and engage the latch arm receiver;

a cam of substantially rigid material affixed to the inner slide member for biasing the latch arm into engagement with the latch arm receiver.

4. A two-way slide assembly comprising:

an outer slide member;

an intermediate slide member slidably connected to the outer slide member, the intermediate slide member being capable of slidably extending from the outer slide member in at least one direction;

an inner slide member slidably connected to the intermediate slide member, the inner slide member being capable of slidably extending from the outer slide member in the at least one direction and an opposing direction;

a latch arm pivotally mounted to the intermediate slide member;

a latch arm receiver on the outer slide member for engaging the latch arm, the engagement of which prevents the intermediate slide member from sliding with respect to the outer slide member in at least one direction:

an aperture in the intermediate slide member of a predetermined size positioned so that a portion of the latch arm can protrude through the aperture and engage the latch arm receiver;

a cam formed of variations in the surface of the inner slide member for biasing the latch arm into engagement with the latch arm receiver.

5. The two-way slide assembly of claim 3 or 4 wherein the latch arm is pivotally mounted with a pivot axis transverse to the intermediate slide member.

6. The two-way slide assembly of claim 3 or 4 wherein the latch arm is pivotally mounted with a pivot axis parallel to the intermediate slide member.

7. The two-way slide assembly of claim 3 or 4 wherein the latch arm is pivotally mounted with a pivot axis perpendicular to the intermediate slide member.

8. The two-way slide assembly of claim 3 or 4 wherein the latch arm receiver is an aperture in the outer slide member.

9. The two-way slide assembly of claim 3 or 4 wherein the latch arm receiver is a receptacle on the outer slide member.

10. A two-way slide assembly comprising:

an outer slide member;

an intermediate slide member slidably connected to the outer slide member, the intermediate slide member being capable of slidably extending from the outer slide member in at least one direction;

an inner slide member slidably connected to the intermediate slide member, the inner slide member being capable of slidably extending from the outer slide member in the at least one direction and an opposing direction;

a latch arm pivotally mounted to the intermediate slide member;

receptacle means on the outer slide member to receive the latch arm, the receipt of which prevents the intermediate slide member from sliding with respect to the outer slide member in the at least one direction;

a cam on the inner slide member for biasing the latch arm into engagement with the receptacle means; and a second cam on the inner slide member for biasing the latch arm out of engagement with the receptacle means.

11. The two-way slide assembly of claim 10 wherein movement of the latching arm is constricted in the at least one direction by the cam and in the opposing direction by the second cam.

12. A slide assembly comprising:

an outer member of a generally C-shaped section having a pair of upper and lower bearing raceways facing vertically inward and at least one aperture within the generally C-shaped section;

an intermediate slide member of a generally C-shaped section having a pair of upper and lower bearing raceways facing vertically outward and a pair of upper and lower bearing raceways facing vertically inward and at least one aperture within the generally C-shaped section;

a first plurality of upper and lower bearings in rolling engagement with the upper and lower raceways of the outer slide member and the upper and lower raceways facing vertically outward of the intermediate slide member;

an inner slide member of a generally C-shaped section having a pair of upper and lower raceways facing vertically outward and at least one cam on the horizontally inward face of the generally C-shaped cross section;

a second plurality of upper and lower bearings in rolling engagement with the upper and lower raceways of the inner slide member and the upper and lower raceways facing vertically inward of the intermediate slide member;

a latch arm pivotally mounted to the intermediate slide member;

the latch arm comprising:

a body having an upper and lower surface of a predetermined contour;

at least one projection extending from the lower surface of the body capable of protruding through at least one aperture of the intermediate slide member and protruding into at least one aperture of the outer slide member;

the upper surface having a contour such that the spacing from the inner slide member to the upper surface of at least one cross section of the latch parallel to the bearing raceways is a distance if at least one projection extending from the lower surface is protruding into at least one aperture of the outer slide member and is another distance if the at least one projection extending from the lower surface is not protruding into at least one aperture of the outer slide member;

with only one of the distances being such that the at least one cam may be placed between the upper surface and the inner slide member; and the mounting means being positioned such that the at least one projection is capable of protruding though the at least one aperture of the intermediate slide member.

* * * * *